US006680702B2

(12) United States Patent
Yde-Andersen et al.

(10) Patent No.: US 6,680,702 B2
(45) Date of Patent: Jan. 20, 2004

(54) RADIO FREQUENCY RESONANT TAGS WITH CONDUCTING PATTERNS CONNECTED VIA A DIELECTRIC FILM

(75) Inventors: Steen Yde-Andersen, Svendborg (DK); Jan Dudek, Aarslev (DK); Jorgen Schjerning Lundsgaard, Svendborg (DK)

(73) Assignee: SCA Packaging N.V., Zaventem (BE)

( * ) Notice: Subject to any disclaimer, the term of this patent is extended or adjusted under 35 U.S.C. 154(b) by 19 days.

(21) Appl. No.: 10/043,987

(22) Filed: Jan. 11, 2002

(65) Prior Publication Data

US 2003/0132892 A1 Jul. 17, 2003

(51) Int. Cl.[7] ..... H01Q 1/38; H01Q 1/36
(52) U.S. Cl. ..... 343/700 MS; 343/895
(58) Field of Search ..... 343/895, 700 MS; 340/572

(56) References Cited

U.S. PATENT DOCUMENTS 4,583,099 A * 4/1986 Reilly et al. ..... 343/895
4,658,264 A * 4/1987 Baker ..... 343/895
6,313,747 B2 * 11/2001 Imaichi et al. ..... 340/572.5

* cited by examiner

*Primary Examiner*—Hoang V. Nguyen
(74) *Attorney, Agent, or Firm*—Licata & Tyrrell P.C.

(57) ABSTRACT

The present invention provides radio frequency resonant tags and methods of manufacturing these tags for use in detection of theft of article for sale. In these tags, the radio frequency is transmitted through a resonance circuit without the need for direct connection of a conducting pattern or conducting patterns, but rather via a dielectric film which is adjacent to the conducting pattern or separates the conducting patterns.

5 Claims, 2 Drawing Sheets

RADIO FREQUENCY RESONANT TAGS WITH CONDUCTING PATTERNS CONNECTED VIA A DIELECTRIC FILM

FIELD OF THE INVENTION

The present invention relates to radio frequency resonant tags for protection of articles of sale from theft. The tag comprises a resonant circuit containing one or more conducting patterns adjacent to or separated by one or more dielectric films without any requirement for direct connection of opposite ends of a single conducting pattern or multiple conducting patterns. Conducting patterns useful in the present invention may comprise polymer-based electronically conducting paints or inks applied via conventional printing, coating or digital printing methods to the item of sale. Alternatively, one or several of the patterns may comprise a metallic foil conductor.

BACKGROUND OF THE INVENTION

Various multiple frequency tags have been described for use in detection of theft of articles on sale.

For example, Kajfez et al. (WO 95/05647) describe a multiple frequency tag comprised of a dielectric substrate. A first resonant circuit including a first inductor coil and having a first predetermined resonant frequency is located on the first surface of the substrate. A second resonant circuit including a second inductor coil and having a second predetermined resonant frequency which preferably is different from the first predetermined resonant frequency is located on the second surface of the substrate. The first inductor coil is positioned on the substrate to partially overlay the second inductor coil in a manner which minimizes the magnetic coupling between the first and second coils. The tag may be employed in any type of detection system including an electronic article security system for protecting articles of sale from theft. Tags of this kind are manufactured by lamination of aluminum foils on a dielectric substrate. This substrate is subsequently printed and etched to form the resonant coils and then coated with adhesive and a protective strippable cover. It is then cut to size and shape.

A corresponding manufacturing process for a similar resonant tag to be utilized for the same purpose has been disclosed by Imaichi et al. in EP 070318 B1.

Hultåker in U.S. Pat. No. 4,9292,928 discloses the application of ink comprising magnetizable particles to a theft protection device.

Appalucci et al., in U.S. Pat. No. 5,142,270 and U.S. Pat. No. 5,241,299, describe a stabilized resonant tag circuit and deactivator for use in an electronic article surveillance system. The tag disclosed in these patents has a substantially planar dielectric substrate having conductors placed on either side where at least one of the conductors includes an inductor. The tag is stabilized by a flexible, substantially planar, tear-resistant, polymeric film adhered to and covering one of the conductors and the substrate. The film provides a vapor barrier which minimizes the effects of body detuning on the circuit and promotes the secured integrity of the tag. The tag may further comprise a deactivator for deactivating the tag in response to an electromagnetic field of sufficient energy to destroy the resonant properties of the circuit, the deactivator being an indented portion of at least one of the conductors such that the conductors are closer to each other at the indented portion than at the remainder of the conductor. The conductors of this device are made of a metallic conductor material such as aluminum foil and prepared using an extrusion coating process not described. The polymeric film which adheres to the conductors and the substrate provide mechanical stability, while the covering polymeric film provides a thin layer impervious to water vapor or other contaminants which may alter the resonating frequency.

U.S. Pat. No. 6,031,458 describes a polymeric radio frequency resonant tag comprising a first conducting pattern connected to a first capacitor electrode applied to a substrate, a dielectric film applied to the first conducting pattern and first capacitor electrode, and a second conducting pattern connected to a second capacitor electrode applied to dielectric film. A connector links the first and second conducting patterns to form an inductive element.

Alternatively, the dielectric film is replaced at the region intended to form a contact electrode via a local capacitor with a capacitor composite applied to the first capacitor electrode and a dielectric film located adjacent to the capacitor composite and applied to the first conductive pattern.

SUMMARY OF THE INVENTION

An object of the present invention is to provide radio frequency resonant tags.

In one embodiment, the tag comprises a resonant circuit containing a single conducting pattern having a first end and a second end and a dielectric film adjacent to or surrounding the single conducting pattern. In this embodiment, a selected frequency is transmitted through the conducting pattern from the first end to the second end. The frequency is then transmitted back to the first end of the conducting pattern via the dielectric film without requiring direct connection of the first and second ends of the conducting pattern.

In another embodiment, the radio frequency resonant tag comprises a resonant circuit containing multiple conducting patterns each separated by a dielectric film. In this embodiment, the selected frequency is transmitted from one conducting pattern to another via the dielectric film without requiring direct connection of the conducting patterns.

DETAILED DESCRIPTION OF THE INVENTION

The present invention relates to radio frequency resonant tags for protection of consumer retail goods from theft. In the tags of the present invention, a selected frequency is transmitted without the need for direct connection between ends of a single conducting pattern or direct connection between layered adjacent conducting patterns It has now been found that a conducting pattern, placed on a dielectric film may be partially inductive and also partially capacitative. That is, the conducting pattern, when placed on a dielectric film can function as a contact electrode for a capacitor, serving as both a capacitor and inductor at the same time. The present invention applies this unique property to resonant circuits, particularly resonant circuits used in resonant radio frequency tags.

In simplest form, the resonant radio frequency tag of the present invention comprises a resonant circuit containing a single conducting pattern adjacent to or surrounded by a dielectric film. The single conducting pattern has a first end and a second end. In this embodiment, a selected frequency is transmitted through the single conducting pattern from the first end to the second end. The selected frequency is then transmitted back to the first end of the conducting pattern via the dielectric film. Accordingly, unlike prior art devices, direct connection of the first end and second end of the conducting pattern is not required to provide a continuously resonating circuit.

Resonant radio frequency tags of the present invention may also comprise a resonance circuit containing more than one conducting pattern, each of which are separated by a dielectric film. In these tags of the present invention, a selected frequency is transmitted from one conducting pattern to another via the dielectric film without the need for direct connection of the conducting patterns.

In this embodiment, multiple conducting patterns can be incised from a metallic foil at the same time to provides sets of identical, matching conducting patterns or mirror image conducting patterns.

Figure 1:
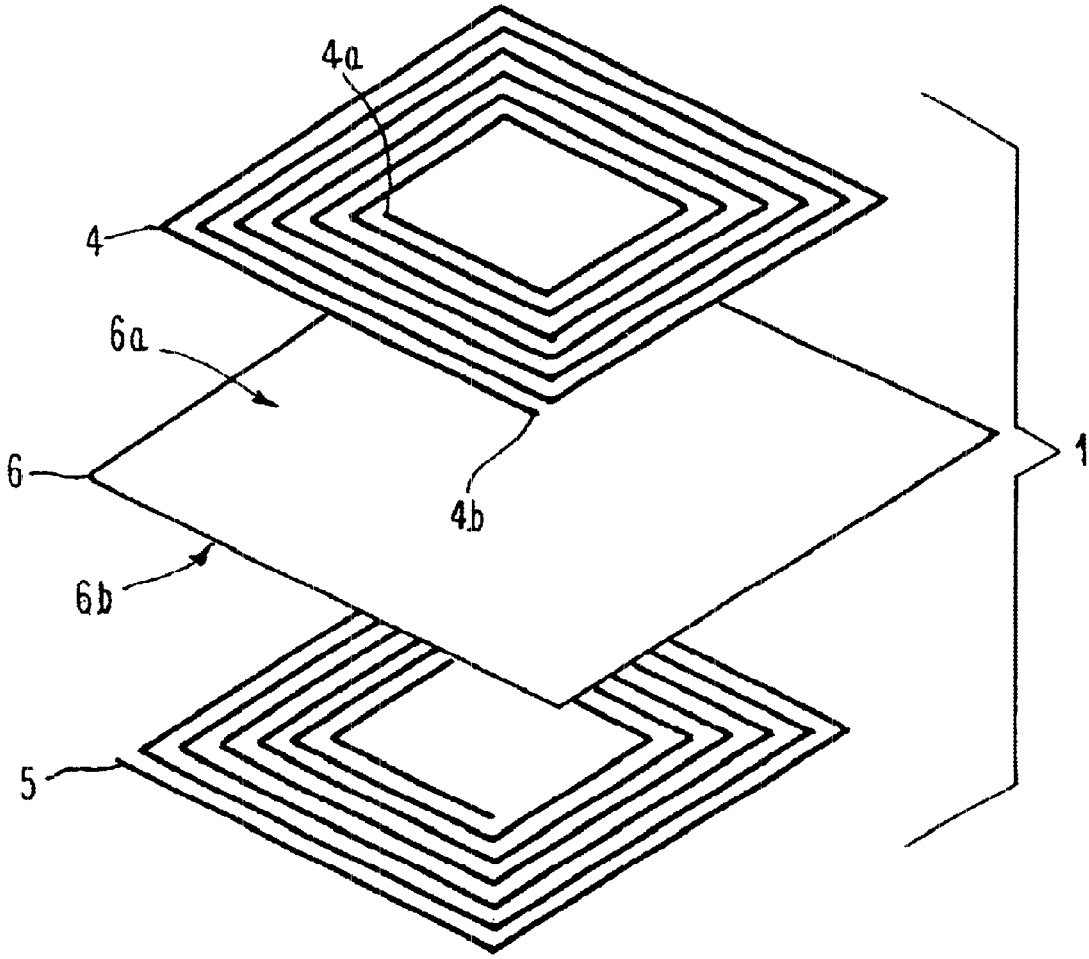
FIG. 1 shows a diagram of a radio frequency resonant tag comprising a resonant circuit containing a first and second conducting pattern separated by a dielectric film. In the embodiment depicted herein, the first and second conducting patterns are identical and applied from above and below, respectively thereby interacting at the proximal intersections to provide increased resonance at a selected frequency without requiring a direct connection between the two conducting patterns.

An embodiment of a tag of the present invention with multiple, identical conducting patterns is depicted in FIG. 1. As shown herein, the resonant radio frequency tag 1 comprises a resonance circuit containing matching conducting patterns, 4 and 5, separated by a dielectric film 6. In this embodiment a first conducting pattern 4 is placed on the top surface 6*a* of the dielectric film 6, while the matching second conducting pattern 5 is placed on the bottom surface 6*b* of the dielectric film 6. In this embodiment, the two matching conducting patterns, 4 and 5, interact to provide increased resonance at a selected frequency without requiring direct connection of the conducting patterns. Instead, in this embodiment of the present invention, the total inductor element is formed of two conducting patterns separated by a dielectric film.

While a traditional foil coil pattern is depicted in FIG. 1, as will be understood by one of skill in the art upon reading this disclosure, this identical set can consist of various optional shapes. Further, the conducting patterns need only be matching at one portion to form a sequence of mini capacitors at the overlapping portions.

Alternatively, the conducting patterns may be mirror images of each other and arranged on the top and bottom surface of the dielectric film so that the conducting pattern on the bottom surface is reversed and superimposed from the conducting pattern on the top surface with no overlap. Total conformity of the patterns constrains the magnetic field induced in this embodiment. This is absorbed in the close passive conducting element and gives the tightest possible inductive coupling to the passive coil. This provides advantages in some embodiments by constraining the inductive property to close limits so that a more pronounced resonance curve can be obtained and the detection device can be set to respond to a tighter frequency range.

Figure 2A:
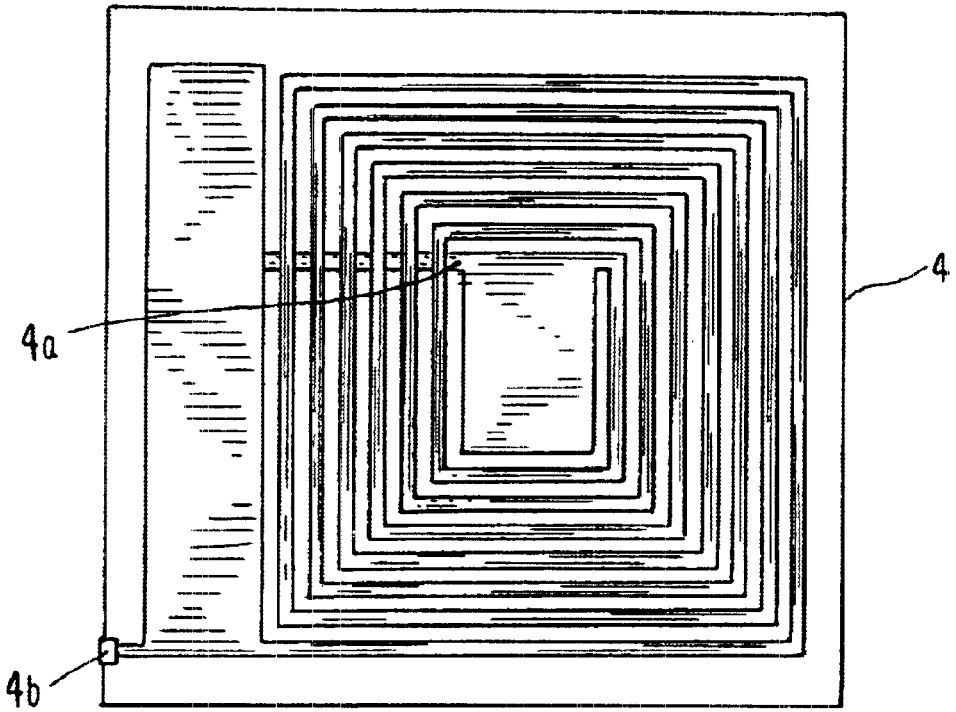
FIGS. 2A and 2B show diagrams of first and second conducting patterns of a radio frequency resonant tag wherein the first and second conducting patterns are different. In this embodiment, the first conducting pattern (depicted in FIG. 2A) placed on the top surface of the dielectric film comprises a classic "coil" while the second pattern (depicted in FIG. 2B) on the bottom surface of the dielectric film is placed so that it overlays the first and second ends of the first conducting pattern thereby functioning as a contact electrode.
Figure 2B:
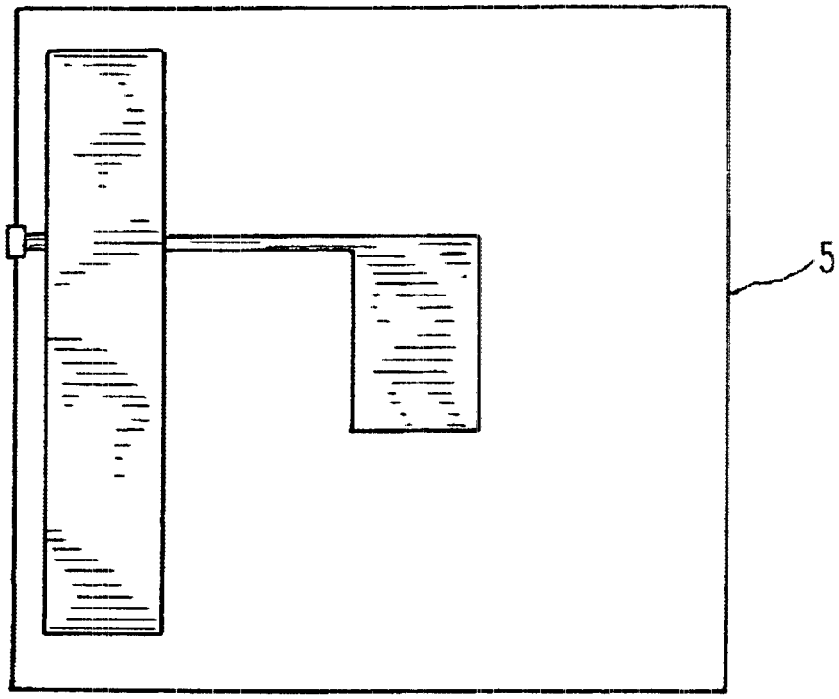

In another embodiment, the conducting patterns are not matching. Instead, as shown in FIG. 2A, a first conducting pattern 4 placed on the top surface of a dielectric film may comprise a classic coil pattern while a second conducting pattern 5, depicted in FIG. 2B, placed on the bottom surface of a dielectric film may simply comprise a pattern which overlays a first end 4*a* of the first conducting pattern 4 with a second end 4*b* of the first conducting pattern 4. Thus, in this embodiment, the second conducting pattern 5 functions as a contact electrode corresponding to both ends, 4*a* and 4*b*, of the first conducting pattern 4.

As will be understood by those of skill in the art upon reading this disclosure, resonant radio frequency tags with resonance circuits comprising more than two conducting patterns, each of which are matching and each of which are separated by dielectric film can also be developed routinely in accordance with the teachings provided herein. Alternatively, resonance circuits for use in resonant radio frequency tags which comprise more than two non-matching conducting patterns, each of which are separated by a dielectric film can also be developed routinely in accordance with these teachings. In addition, resonant radio frequency tags with resonance circuits comprising more than two conducting patterns, some of which are matching and some of which are non-matching, and each of which are separated by dielectric film can also be developed routinely in accordance with the teachings provided herein.

Conducting patterns in the resonant tags of the present invention may comprise any suitable conductive material that exhibits sufficient conductivity to transmit a selected radio frequency. Various suitable conductive materials useful in the present invention are well known to those skill in the art. Examples of suitable conductive materials include, but are not limited to polymeric conducting paints and inks and metallic foil coils.

In one embodiment of the present invention, the conducting pattern or patterns comprise electronically conductive composites of paint or ink. A conductive paint or ink suitable for this purpose can be manufactured by mixing electronically conductive particulate materials in a polymeric binder. The polymeric binder may be selected from any polymeric material in which the transformation from low molecular weight precursor liquid or plastic form to a solid form consisting of three-dimensionally chemically bonded precursors can be effectuated by a polymerization process. A further criteria is that the polymeric binder must be compatible with and adherable to the dielectric film.

Paints or inks with these characteristics are commercially available from DuPont Electronics of TABY Sweden as CB polymer thick film pastes. For example, CB210 Copper-conductor Polymer Thick Film paste, is particularly suitable for use on flexible substrates. Alternatively, paints or inks can be manufactured by compounding finely divided electrically conductive materials, such as metal powder, conductive carbon-black or graphite, in a resin base to yield a electrically conductive paint with good adhesive properties. The inductance of these paints or inks may optionally use conventional techniques providing a ferro-magnetic core. For example, the inductance may be enhanced by applying a ferrite composite material in the open center portion of the conductor coil. Materials that are suitable can be manufactured by mixing together a binder polymer such as CB018 UV curable dielectric and ferrite material which is conventionally used in similar applications in electronics as is well known by those versed in the art. Alternatively Ferrite Powder Composites (FPC) manufactured by Siemens, Federal Republic of Germany may be used.

In another embodiment of the present invention, the conducting pattern or patterns comprise metallic foil coils. Use of such coils, connected directly to one another and/or a separate contact electrode, in resonant radio frequency tags is well established and described by Appalucci et al. in references such as WO 92/21113 and U.S. Pat. Nos. 5,841,350, 5,861,809 and 5,142,270. Standard techniques for preparation of foil coils for use in resonant tags include, but are not limited to, chemical etching, extrusion of foils, or stamping of foils. Various metallic foils can be used to produce the conducting patterns of the tag. For example, metallic copper foils can be used. Aluminum foils are also suitable. Such foils are commercially available which are useful materials for the making of resonant circuits such as tags. Other foils used commonly in the food packaging industry as impermeable packaging materials can also be used.

Composite foil coils can also be used. For example, a composite foil coil designated A15Cu composite foil can be used. This composition foil comprises a layer of 12 microns thickness of polyethylene-terephthalate (PET) on which a layer of polyethylene (PE) is applied. The PE layer has a thickness corresponding to a distributed weight of 12 grams per square meter. Subsequent superimposition of a layer of copper foil having a thickness of 15 microns provides the conductive material of the conducting pattern of the tag. The final layer of the metallic composite foil is composed of Surlyn 1562 ionomer (E. I. Dupont, Wilmington. Del. USA). The Surlyn layer has a weight of 55 grams per square meter and has the function of providing a hot-melt adhesive in the subsequent assembly step in which the patterns in the set are bonded to a dielectric film to form the tag.

In yet another embodiment of the present invention, wherein multiple conducting patterns are used in the resonant circuit, one or more of the conducting patterns may comprise a polymeric conducting paint or ink and one or more of the conducting patterns may comprise a metallic foil coil.

Materials suitable for use as dielectric films in the resonant radio frequency tags of the present invention are also well known. The dielectric film which separates the conducting patterns while permitting a radio frequency to be transmitted from one end of a conducting pattern to the other end or from one conducting pattern to another without the need for a connector preferably comprises an electrically insulating polymeric material such as may be used for insulation purposes. Where high capacitance is required composite materials can be used. Suitable composite materials are well known to those skilled in the art. For example, Kingery et al., (*Introduction to Ceramics,* 2nd Ed. ISBN 0-0471-47860-1 (John Wiley & Sons, Inc. New York, USA) describe ferro-electric materials of the perovskite class, such as barium titanate strontium titanate, barium-strontium titanate or lead titanate which can be exploited to manufacture capacitors with high dielectric constants for use as laminar capacitors. These materials can be incorporated into polymers films or paints. Alternatively, they can be extruded or made by tape casting and subsequently sintered to produce rigid capacitative materials. Alternatively, the material can be applied as a fluid mixture with a liquid curable polymer as the matrix. The volume content of the disperse phase, which is the material with the highest dielectric constant, and the thickness of the film deposited determine the value of the capacitance obtained. These materials have a wide variation with respect to the volume content of Barium, Strontium or Lead titanate content. Rheological considerations limit the maximum volume fraction of titanate to below 70 volume %. For pastes capable of coating to a thickness of 10 to 50 microns, a solids content of approximately 60 volume % is optimal.

Polymeric electrically insulating dielectric films can be applied by various methods known by those skilled in the art. Such methods can involve calendared or extruded laminar sheets, doctor blade coating methods, printing or by digitally controlled ink-jet printing devices. Other methods can involve coalescing a polymerically bound powdered form of the material which subsequently may be melted by the application of heat into a non-porous film directly onto the previously applied conducting pattern using a digitally controlled laser printer device. However, as known to those skilled in the art, simple polymeric materials may also have suitable dielectric properties to provide the necessary capacitance.

Deactivation of the resonant radio frequency tag can be achieved via a weak or fusible link in one or several of the conducting patterns. In this embodiment, an electromagnetic field is applied to the fusible link constriction at a selected resonant frequency to deactivate the tag. Alternatively, deactivation can be achieved by creating a break down voltage in the dielectric film which is reached when the tag is exposed to a higher deactivation power. In a preferred embodiment, the selected frequency of deactivation is 8.2 MHZ as used in conventional antenna technology. A deactivation spot is preferably included in the dielectric film for ease in identifying the most effective placement of the deactivation device. The deactivation spot comprises a small region in the dielectric composite having a lower breakdown potential to facilitate deactivation of the device.

The tag may also be assembled on an adhesive film supported by a silicone paper so that the tag can be supplied for use as a self-adhesive tag in a manner similar to the supply of stickers and labels. Such adhesion elements are used routinely by those of skill in the art.

Various methods for producing the radio frequency resonant tags of the present invention can be used. Some preferred methodologies are set forth in the Examples. However, as will be understood by those of skill in the art upon reading this disclosure, other methods to those exemplified herein can be used.

In one embodiment, the method comprises mounting of the metal foil coil conducting patterns onto the dielectric film. In this embodiment, the metal foil preferably comprises a continuous foil prepared via a conventional Flat bed signmaking cutter such as the Wild TA30 Flat bed plotter cutter. Metal foil coils useful in the present invention may also be purchased from commercial suppliers. The metal foil coil is then coated with an adhesive lacquer which enables the subsequent bonding of the conductive pattern to a dielectric foil in a subsequent assembly step. In a preferred embodiment, the amount of lacquer used deposits a dry distributed coating having a weight of about 1–10 grams per $m^2$ and a thickness of about 25 to 500 microns.

The coating can be applied by various means including, but not limited to, spraying or by roller coating, and then air-dried at room temperature or more preferably in an oven at a temperature of about 40 to about 60° C.

Alternatively, the method comprises preparation of tags from composite materials such as described in U.S. Pat. No. 6,031,458, the teachings of which are herein incorporated by reference. Other methods of manufacture of the tags of the present invention include the multiple layering of foils of a conductive pattern on a both sides of a dielectric foil and covering both sides with a heat-bondable plastic protection film such as Surlyn 1562 ionomer (E. I. DuPont, Wilmington, Del.).

In embodiments with multiple conducting patterns, bonding together of the patterns separated by the dielectric film or films is most often performed at a temperature of about 130° C. for about 2 minutes at 5 bars surface pressure.

The following non-limiting examples are provided to further illustrate the present invention.

EXAMPLES

Example 1

Production of Metal Foils Mounted on an Application Foil

The equipment used to produce metal foil coils mounted on an application foil is a conventional incisor such as a Wild Flat-bed TA30 plotter fitted with a cutter head (Sign-Tronic Scandinavia A/S, Denmark) and equipped with Sign-tronic software (Sign-Tronic Scandinavia A/S, Denmark). This is standard equipment widely used in the manufacture of signs and posters from PVC sheets.

A process aid termed an "application foil" is used to provide temporary fixation of the metal foil subsequent to incision and assembly of the tags. The application or mounting foil has a suitable adhesive applied which enables fixation at the same time as allowing easy peeling of the metal foil coil from the application foil at a later stage. A suitable application foil, referred to herein as Ap3m, comprises FP76-medium (R&D Danmark, Denmark). Similar foils are made by 3M and are widely used in the graphic sector for similar purposes.

Various metallic foils may be used as the conductive material in the tag. In one embodiment a metallic copper foil is used. Aluminum foil is also suitable. Alternatively, flexible plastic coated metallic foil routinely sold as flexible plastic food packaging materials (Danapak A/S Denmark) can be used. Some preferred metallic flexible foils used in the manufacture of the tags of the present invention include:

Foil #5—A foil with 5 composite foil layers of 12 microns thickness of (PET) polyethylene-terephthalate. Subsequent layer of aluminum foil having a thickness of 9 microns provides the conductive material of the inductive element of the tag. The final layer of the metallic composite foil is composed of Surlyn 1562 ionomer supplied by E. I. Dupont, Wilmington. Del. USA. The Surlyn layer has a weight of 30 grams per square meter and has the function of providing a hot-melt adhesive in the subsequent assembly step where the conductive patterns in the set are bonded to a dielectric film to form the tag.

Foil #25—This foil consists of a 12-micron layer of polyethylene terephthalate (PET) bonded by a layer of low-density polyethylene (PE), having a thickness corresponding to 12 grams per square meter, to a 15-micron thick aluminium foil. The aluminum foil is bonded to a Surlyn 1652 layer having a thickness corresponding to a spread of 55 grams per square meter.

The metal foil is prepared for cutting by laminating the composite foil onto the temporary application foil. The continuous metal foil is adhered to the application foil by overlaying the application foil and applying pressure. For preparation of small numbers of tags this is done in a frame and a specific pressure of approximately 1 bar (0.5 to 5 bars) is applied in a press such as a printing press. In industrial practice this is done in a continuous process using pressure rollers or calendars.

The coil pattern is cut on the Wild TA30 flatbed cutter using a pattern previously set-up in the Signtronic CAM software. The patterns are then bonded to the dielectric at typically 130° C. for 2 minutes at 5 bars surface pressure.

Example 2

Resonant Frequencies of Tags with Multiple Conducting Patterns

Various tags with multiple conducting patterns were prepared via the method set forth in Example 1 and their resonant frequencies were measured. Tags are comprised of top and reverse side identical foil coils with no direct electrical contact between the 2 parts.

The following foils were used in the tags:

Foil no 5: PET 12 $\mu$/Alu 9 $\mu$/Surlyn 30 g

Foil no 25: PET 12 $\mu$/PE 12 g /Alu 15 $\mu$/Surlyn 1652 55 g

Foil Aluminum foil—hard aluminum 20$\mu$

Various tag configurations and measurements of their resonant frequency and their quality factor are depicted in the following table.

| Tag Nr. | Foil No | App. Foil | Temp (° C.) | Press (bar) | Time (min) | Freq. (MHz) | Q |
|---|---|---|---|---|---|---|---|
| 1 | 5/5 | Ap3m | 130 | 1 | 2 | 9.62 | 27.5 |
| 2 | 5/5 | Ap3m | 130 | 1 | 2 | 9.8 | 26.5 |
| 3 | 5/5 | Ap3m | 130 | 1 | 2 | 9.9 | 23.1 |
| 4 | 5/5 | Ap3m | 130 | 2 | 2 | 9.28 | 23.2 |
| 5 | 5/5 | Ap3m | 130 | 2 | 2 | 8.4 | 24 |
| 6 | 5/5 | Ap3m | 130 | 2 | 2 | 8.7 | 24.9 |
| 7 | 5/5 | Ap3m | 130 | 3 | 2 | 8.59 | 20.0 |
| 8 | 5/5 | Ap3m | 130 | 3 | 2 | 7.79 | 21.6 |
| 9 | 5/5 | Ap3m | 130 | 3 | 2 | 8.12 | 22.6 |
| 10 | 5/5 | Ap3m | 110 | 3 | 2 | 9.43 | 22.5 |
| 11 | 5/5 | Ap3m | 110 | 3 | 2 | 9.06 | 24.5 |
| 12 | 5/5 | Ap3m | 110 | 3 | 2 | 8.47 | 22.3 |
| 13 | 5/5 | Ap3m | 110 | 1 | 2 | 10.38 | 28.1 |
| 14 | 5/5 | Ap3m | 110 | 1 | 2 | 10.36 | 26.6 |
| 15 | 5/5 | Ap3m | 110 | 1 | 2 | 10.67 | 22.7 |
| 16 | 5/5 | Ap3m | 110 | 2 | 2 | 9.69 | 21.5 |
| 17 | 5/5 | Ap3m | 110 | 2 | 2 | 9.2 | 24.7 |
| 18 | 5/5 | Ap3m | 110 | 2 | 2 | 9.86 | 22.4 |
| 19 | A/5 | Ap3m | 110 | 2 | 2 | 7.02 | 23.1 |
| 20 | A/25 | Ap3m | 110 | 2 | 2 | 8.34 | 26.6 |

The quality factor Q expresses the peak height of the resonance curve at the resonant frequency. The Q factor is reduced by increasing ohmic loss in the resonant circuit so that designs, which have a high Q factor, have a relatively lower ohmic resistance. The bandwidth and selectivity of the circuit are correlated to the Q factor so that a selective and sensitive circuit has a high Q.

Because of the consideration of factors affecting the quality factor Q, a resonant circuit should have low ohmic resistance. Thus the inductive element should ideally be as short as possible, and consist of a material having a high conductivity.

Example 3

Resonant Tags with Single Conducting Pattern

Resonant tags of the present invention with a single conducting pattern also exhibited a Q factor indicative of such tags being useful.

One tag tested comprised a square inductor having an internal length of 2 centimeters and a conductor width of 0.75 cm that formed the single coil conducting pattern. This conducting pattern was fixed directly on to a piece of paper. Two capacitors, each having a capacitance of 5 nF were connected to the coil in parallel. The circuit resonated at 7.8 MHz.

Another tag tested comprised a circuit made of one square coil with a side length (mean) of 40 mm and a conductor width of 7.5 mm similarly attached to a 4.4 nF capacitor component. This tag had a resonant frequency of 9.0 MHz. In this embodiment, the coil was made of silver paste as described in U.S. Pat. No. 6,031,458. The paste was applied directly onto a paper card surface. The circuit had an inductance of 70 $\mu$H. The circuit was able to trigger an exit gate tuned at 8.3 MHz.

Another tag tested comprised a single 3,2 int pitch square coil copper inductor, placed on paper, and connected to a 5.96 nF capacitor. This tag also triggered the exit gate and had a resonant frequency of 7.8 MHz.

For all tests with these tags, the composite capacitor was replaced in function by a bought in hardware component. The Q was not measured but articles were tested on their ability to trigger the normal equipment used for monitoring goods on exit from commercial points of sale.

What is claimed is:

1. A resonant radio frequency tag comprising a resonant circuit containing a single conducting pattern having a first end and a second end and a dielectric film adjacent to or surrounding the single conducting pattern, said resonant circuit transmitting a selected frequency through single the conducting pattern from the first end to the second end and then back to the first end of the conducting pattern via the dielectric film without requiring direct connection of the first and second end of the conducting pattern.

2. A radio frequency resonant tag comprising a resonant circuit containing multiple conducting patterns each separated by a dielectric film, said resonant circuit transmitting a selected frequency through the multiple conducting patterns via the dielectric film without requiring direct connection of the multiple conducting patterns.

3. The radio frequency resonant tag of claim 2 wherein the multiple conducting patterns are identical.

4. The radio frequency resonant tag of claim 2 wherein the multiple conducting patterns are mirror images.

5. The radio frequency resonant tag of claim 2 wherein the multiple conducting patterns are non-matching.

* * * * *